United States Patent [19]

Okawa

[11] 3,967,693

[45] July 6, 1976

[54] APPARATUS FOR DISMISSING OR DECREASING SOUND'S ENERGY

[75] Inventor: Isao Okawa, Tokyo, Japan

[73] Assignee: Asahi Kasei Kogyo Kabushiki Kaisha, Osaka, Japan

[22] Filed: May 23, 1974

[21] Appl. No.: 472,882

[30] Foreign Application Priority Data

May 24, 1973 Japan ..... 48-57157[U]

[52] U.S. Cl. ..... 181/33 G; 52/145; 181/33 K

[51] Int. Cl.[2] ..... E04B 1/82

[58] Field of Search ..... 181/33 K, 33 G; 52/144, 52/145, 300, 319, 602

[56] References Cited

UNITED STATES PATENTS

| | | | |
|---|---|---|---|
| 1,705,778 | 3/1929 | Munroe et al. | 181/33 K UX |
| 1,846,887 | 2/1932 | Matthews | 181/33 K UX |
| 2,808,122 | 10/1957 | Meyers | 181/33 K UX |
| 3,132,715 | 5/1964 | Dunsbee | 181/33 K UX |
| 3,656,576 | 4/1972 | Gubela | 181/334 E X |
| 3,814,208 | 6/1974 | Morresi et al. | 181/33 G |
| 3,820,627 | 6/1974 | Wirt | 181/33 K X |
| 3,846,949 | 11/1974 | Okawa | 181/33 G X |

FOREIGN PATENTS OR APPLICATIONS

| | | | |
|---|---|---|---|
| 986,419 | 3/1951 | France | 181/33 G |
| 1,121,259 | 4/1956 | France | 52/145 |
| 87,329 | 6/1966 | France | 181/33 G |
| 1,187,027 | 2/1965 | Germany | 181/33 K |
| 1,942,116 | 3/1971 | Germany | 181/33 K |
| 1,946,561 | 4/1971 | Germany | 181/33 K |
| 338,013 | 6/1959 | Switzerland | 181/33 G |

*Primary Examiner*—John F. Gonzales
*Attorney, Agent, or Firm*—Fleit & Jacobson

[57] ABSTRACT

There is disclosed a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

3 Claims, 8 Drawing Figures

APPARATUS FOR DISMISSING OR DECREASING SOUND'S ENERGY

BACKGROUND OF THE INVENTION

This invention relates to a resonant method and a resonant apparatus comprised of a wall body or bodies which reduce a sound's pressure within a whole sound field, which field has a certain extent. The invention provides wall surfaces of prescribed construction as a resonant wall body or bodies at the side of a sound's source. The invention especially relates to a method and an apparatus of decreasing sound's energy comprising wall surfaces which enable remarkably reduced sound pressure in a whole sound field at the side of a sound's source. The apparatus comprises: a porous outside cover coat-laminated to the external edges of the body ribs. The bodies may be made of heavy materials such as metals and concrete etc. The ribs are set at given intervals to the vertical or to the horizontal or to both directions. The resonant wall body or bodies is formed by isolating open edges of the airlayer with rigid materials and forming wall surfaces so as to screen a sound's source using said resonant wall body or bodies. The sound from said sound's source is resonated in a whole space composed of said resonant wall body or bodies as well as the enclosed volume of the body or bodies.

Known resonant walls have rib materials comprised of materials such as Copenhagen rib etc. and are used as a finishing material of a wall for special buildings such as concert halls, public halls, or the like. This known type of resonant wall, however, has a simple construction with many ribs on the surface of the wall. The object of such walls is only to give an absorptive action of sound on the wall so as to make the sound's pressure within the enclosure constant without changing the tone quality. The walls are not intended for remarkably reducing the sound's energy from a sound's source in the whole space.

Furthermore, the soundproof wall used to conform to public nuisance requirements cannot reduce a sound's pressure in an entire sound field at the side of sound's source because such walls generally diminish the sound as a function of the sound's distance notwithstanding the existence of the sound absorptive properties of the material.

SUMMARY OF THE INVENTION

The present invention relates to a method and an apparatus of reducing resonance of a wall face which enables reducing a sound's pressure at the side of sound's source in a whole sound field (having a certain extent) comprising: a resonant wall body or bodies having a special construction. Whole surfaces of which wall are made into resonant bodies for screening the sound's source with said resonant wall body or bodies; and all of the screened sound's field is made into a resonant mechanism to overcome the defects of known devices.

DETAILED DESCRIPTION OF THE PREFERRED EMBODIMENT

In explaining an example according to the present invention with drawings, A is a resonant wall body or bodies according to the invention. Body A screens the sound's source B having a motor, engine and transformer, etc. in a given direction.

Figure 1:
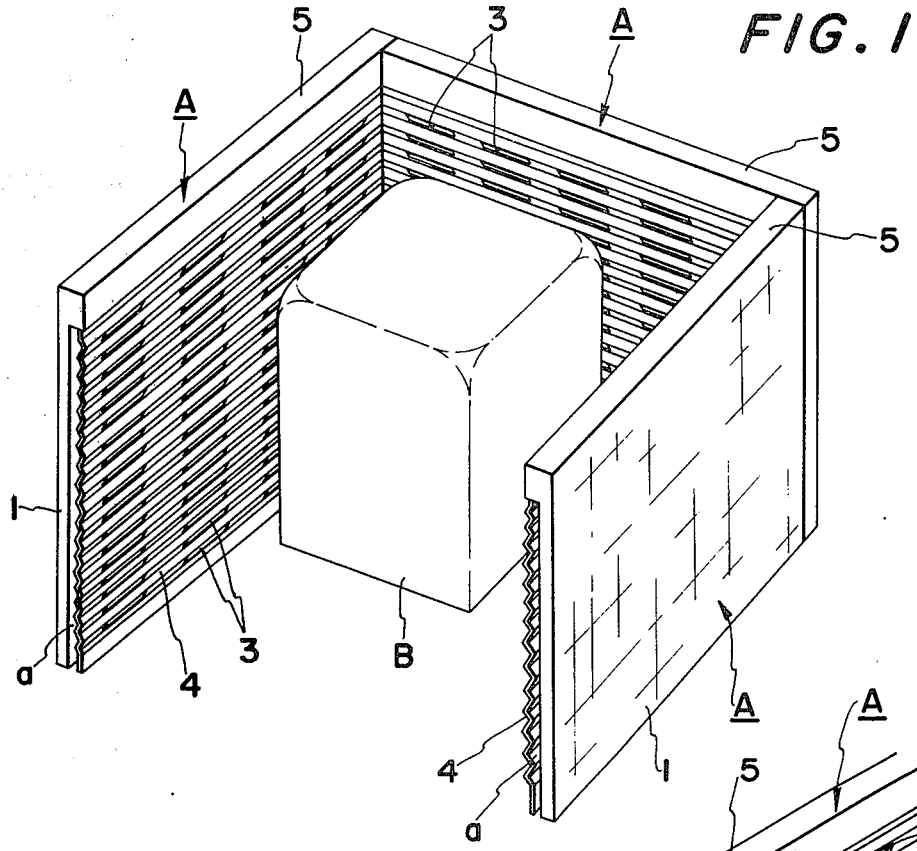
FIG. 1 is a perspective view showing the apparatus of the present invention.
Figure 2:
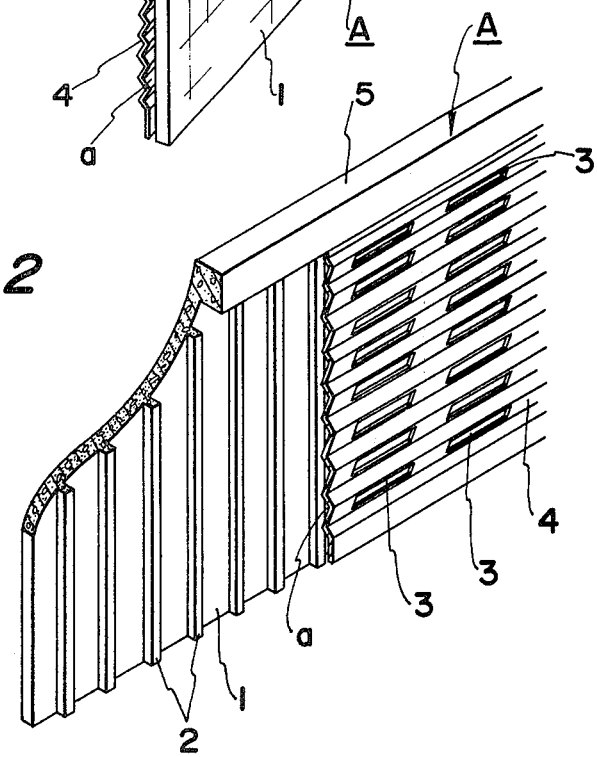
FIG. 2 is a partially enlarged sectional view of FIG. 1.

The construction of resonant wall body A, as especially shown in FIG. 2, is formed as a whole by providing many comparatively tall ribs 2 toward the vertical direction with therebetween given intervals at surface of wall body 1. The wall is made of metals such as iron plate and aluminum plate, etc., or of heavy materials such as concrete, slate and concrete block, etc. An outside cover 4 having a bent hidden side and surface in wave form and having many small porous holes 3 in the recess of said bent side is closely laminated to said ribs. An edge plate 5 made of a rigid material is attached to the edge face of external circumference of the combined wall body 1 and porous outside cover having wave form 4. Lastly, an open edge of an airlayer is completely isolated.

Based upon the construction of the resonant wall body described above, the air in each small chamber formed in the wall composed of wall 1, ribs 2, porous outside cover in wave form 4 and edge plate 5, enables the sound to disappear by reducing the sound's energy when said sound is resonating with a given frequency. An elastic body is formed in which the air in front and rear of the small holes serves as a weight, so that when the sound's wave strikes against the small holes made in recess of porous outside cover in wave form 4, the pressure thereof is reduced.

The insertion of other porous and absorptive materials such as glass wool, etc., into the small chamber a of the resonant wall body A is also possible.

In such a case, the frequency of resonance moves slightly toward the lower side of the frequency scale and the rates of absorption of sound in both middle and high area increases.

In formation of the resonant wall body A, the frequency of resonance becomes important, and said frequency of resonance is determined by a number of factors such as: the height of rib 2, the rate of, or number of the open holes 3 per peepface, which holes are made in the face of porous outside cover in wave form 4, the size of each hole 4, and the intervals therebetween.

Several forms of porous outside covers such as zigzag form and wave form of countinuous parabola, etc. are possible, and naturally the holes 3 are made in the recess of the wave form.

The frequency of resonant wall body A is calculated from the following formula:

$$\text{freq} = \frac{c}{2\pi} \sqrt{\frac{p}{100h\,(lo + le)}}$$

wherein

C: speed of sound (cm/sec) (HZ)
h: height of air-layer in rear (cm)
p: rate of opening hole (%)
lo: thickness of surface plate (cm)
le: edge correction (cm)

For instance, for the following values:

$c = 34000$ cm/sec, $p = 14.4\%$, $h = 10$ cm, lo = 6 cm, le = 2 × 2.5 cm, there is obtained $$\text{freq} = \frac{34000}{2\pi} \times \sqrt{\frac{14.4}{100 \times 10\,(6 + 2 \times 2.5)}} = 190\text{HZ}.$$

In other words, the resonance is obtained at 190 HZ.

Figure 3A:
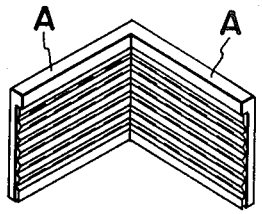
FIG. 3A is a perspective view illustrating a method of screening the sound's source.
Figure 3B:
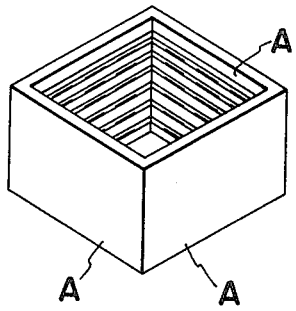
FIG. 3B is an apparatus embodying the teachings of the present invention.
Figure 3C:
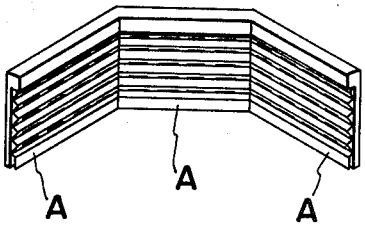
FIG. 3C shows a perspective view of three walls according to the present invention.
Figure 3:
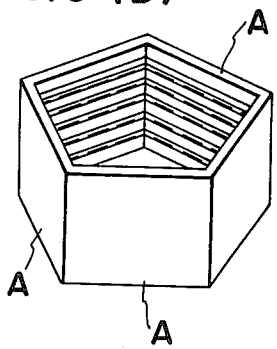
FIG. 3D shows another form of an apparatus embodying the teachings of the present invention.
FIG. 3E shows two sections of wall embodying the present invention.
FIG. 3F shows an apparatus embodying the teachings of the present invention.
Figure 3E:
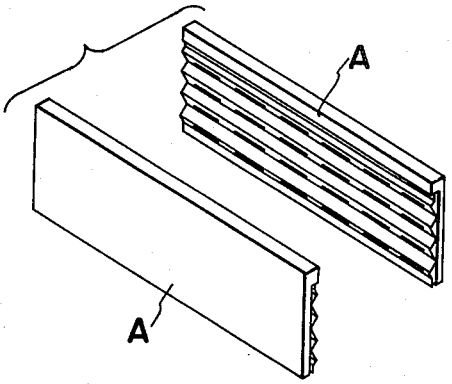
Figure 3:
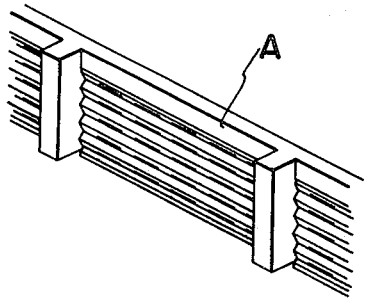

In a method of screening the sound's source B with the resonant wall body A according to the present invention, several methods are considered, examples of which are shown in FIG. 3. In the case of screening the circumference completely, the result obtained with the alternative embodiments shown in FIG. 3 is closer to the calculated result.

In this case, the sound's pressure in the whole sound field (having a given extent) is reduced at the side of the sound source by resonating the sound with a whole screened chamber, thus making said chamber into a resonant wall body.

In the example described above, though the explanation thereof only referred to an example wherein the circumference is screened by the resonant wall body A, the upper and lower faces of the sound's source B should also be screened according to necessity.

A first case I, in which the apparatus of resonance according to the present invention is used, and a second case II, in which the apparatus according to the conventional concrete block is used, have been compared. The two cases were tested by screening a transformer which becomes the sound's source in each case concretely under same conditions. The results are obtained as follows.

| (1) Measurements in Transformer chamber dB (c) all pass | | 63HZ | 125HZ | 250HZ | 500HZ | 1KHZ |
|---|---|---|---|---|---|---|
| | I | 68 | 62 | 59 | 65 | 64 | 56 |
| | II | 90 | 69 | 90 | 77 | 69 | 60 |

(2) Measurements outside Transformer Chamber dB (A)

distance from

-continued

| (1) Measurements in Transformer chamber dB (c) all pass | | 63HZ | 125HZ | 250HZ | 500HZ | 1KHZ |
|---|---|---|---|---|---|---|
| wall face | | 1 | 2 | 4 | 8 | 16 |
| noise level dB (A) | I | 40 | 37 | 37 | 36 | 31 |
| " | II | 59 | 56 | 59 | 51 | 48 |

In the case using the resonant mechanism according to the present invention, as is clear from the measured tables described above, the sound absorptive effect of the invention is clearly superior to the conventional case of concrete block mechanism. The superiority is evident both inside and outside the transformer chamber. In case I, especially, at 125 HZ, which is close to the frequency of resonance in the chamber or at the side of sound's source, the pressure level of sound in Case II was 90 dB (c), and was reduced to 59 dB (C) in I.

The method of resonance according to the present invention as described above, has a characteristic which enables it to reduce the sound energy at the side of sound source by: laminating the porous outside cover 4 to the outside rib of the wall body; isolating the open edge of the air-layer with edge material 5; disappearing the sound by resonating the absorped sound from small holes in the outside cover in small chambers, many of which are constructed in the wall body; making a resonant body with a whole space formed by surrounding the sound source with the resonant wall body; and resonating the sound with said whole body.

I claim:

1. A sound decreasing means for decreasing the pressure of sound at a wall surface comprising:

a vertical wall;

a plurality of spaced apart ribs, each attached to said wall;

an edge plate attached to said ribs and to said wall along the top horizontal edge thereof;

a cover coat laminated to each of said ribs and oriented essentially parallel with said wall so that said cover and said wall form with said ribs and said edge plate a plurality of chambers, said cover comprising a porous surface bent into a wave-form having peaks and recesses, said surface having defined therethrough a plurality of holes associated with each chamber and positioned in said recesses of said surface so that air can enter into each chamber through said plurality of holes.

2. The sound decreasing means of claim 1 wherein said wall is formed of metal.

3. The sound decreasing means of claim 1 wherein said wall is formed of heavy materials.

* * * * *